US008029627B2

(12) United States Patent
Gerster

(10) Patent No.: US 8,029,627 B2
(45) **Date of Patent: *Oct. 4, 2011**

(54) CORROSION RESISTANT MAGNETIC COMPONENT FOR A FUEL INJECTION VALVE

(75) Inventor: Joachim Gerster, Alzenau (DE)

(73) Assignee: Vacuumschmelze GmbH & Co. KG, Hanau (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/829,677

(22) Filed: Jul. 27, 2007

(65) Prior Publication Data

US 2008/0136570 A1 Jun. 12, 2008

Related U.S. Application Data

(63) Continuation-in-part of application No. 11/343,558, filed on Jan. 31, 2006.

(51) Int. Cl.
*H01F 1/147* (2006.01)

(52) U.S. Cl. ..... 148/311; 148/307; 148/309

(58) Field of Classification Search ..... None
See application file for complete search history.

(56) References Cited

U.S. PATENT DOCUMENTS

| | | | | |
|---|---|---|---|---|
| 2,225,730 | A | 12/1940 | Armstrong | 148/31 |
| 3,401,035 | A | 9/1968 | Moskowitz et al. | |
| 4,120,704 | A | 10/1978 | Anderson | 148/103 |
| 4,171,978 | A * | 10/1979 | Inoue | 420/36 |
| 4,236,919 | A * | 12/1980 | Kamino | 420/36 |
| 4,324,597 | A * | 4/1982 | Kamino et al. | 148/103 |
| 4,969,963 | A | 11/1990 | Honkura et al. | 148/307 |
| 4,994,122 | A | 2/1991 | DeBold et al. | 148/306 |
| 5,091,024 | A | 2/1992 | DeBold et al. | 148/306 |
| 5,202,088 | A | 4/1993 | Genma et al. | 420/40 |
| 5,534,081 | A * | 7/1996 | Takagi et al. | 148/325 |
| 5,769,974 | A | 6/1998 | Masteller et al. | 148/651 |
| 5,817,191 | A | 10/1998 | Emmerich et al. | 148/311 |
| 6,168,095 | B1 | 1/2001 | Seitter et al. | 239/533.3 |
| 6,181,509 | B1 | 1/2001 | Canlas et al. | 360/97.01 |
| 6,616,125 | B2 | 9/2003 | Brown et al. | 251/368 |
| 6,942,741 | B2 | 9/2005 | Shimao et al. | 148/312 |
| 6,962,144 | B2 * | 11/2005 | Chretien et al. | 123/499 |
| 2003/0034091 | A1 * | 2/2003 | Shimao et al. | 148/100 |

(Continued)

FOREIGN PATENT DOCUMENTS

| | | |
|---|---|---|
| DE | 10031923 | 1/2002 |

(Continued)

OTHER PUBLICATIONS

Stahlschlüssel 1958. Marbach: Verlag Stahlschlüssel Wegst GmbH, 1998, Version 2.0, ISBN 3-922599-15-X, Window "Analyse-Suche" Sep. 11, 2007.

(Continued)

*Primary Examiner* — John Sheehan

(74) *Attorney, Agent, or Firm* — Buchanan, Ingersoll & Rooney PC

(57) ABSTRACT

A magnetic component for a magnetically actuated fuel injection device is formed of a corrosion resistant soft magnetic alloy consisting essentially of, in weight percent, 9%<Co<20%, 6%<Cr<15%, 0%≦S≦0.5%, 0%≦Mn≦4.5%, 0%≦Al≦2.5%, 0%≦V≦2.0%, 0%≦Ti≦2.0%, 0%≦Mo≦2.0%, 0%≦Si≦3.5%, 0%≦C<0.05%, 0%≦P<0.1%, 0%≦N<0.5%, 0%≦O<0.05%, 0%≦B<0.01%, and the balance being essentially iron and having at least one of Al, V, Ti and Mo.

11 Claims, 16 Drawing Sheets

U.S. PATENT DOCUMENTS

| | | | | |
|---|---|---|---|---|
| 2004/0025841 | A1* | 2/2004 | Chretien et al. | 123/446 |
| 2004/0099347 | A1 | 5/2004 | Waeckerle et al. | 148/311 |
| 2008/0099106 | A1* | 5/2008 | Pieper et al. | 148/122 |
| 2008/0136570 | A1* | 6/2008 | Gerster | 335/302 |

FOREIGN PATENT DOCUMENTS

| | | | |
|---|---|---|---|
| EP | 0216457 | | 7/1986 |
| JP | 56-3185 | * | 1/1981 |
| JP | 56-126903 | * | 10/1981 |
| JP | 2301544 | | 12/1990 |
| JP | 08-246109 | * | 9/1996 |
| JP | 2007113148 | | 5/2007 |
| SU | 338550 | | 5/1972 |
| SU | 431262 | | 6/1974 |
| WO | 2007088513 | | 8/2007 |

OTHER PUBLICATIONS

Bohler N114 Extra; Nichtrostender Weichmagnetischer Stahl Stainless Soft Magnetic Steel; Bohler Edelstahl GMBH & Co KG; (10 pages), Sep. 1, 1995.

Carpenter Specialty Alloys; Alloy Data, Chrome Core 8 & 8-FM Alloys and Chrome Core 12 & 12-FM Alloys; Carpenter Technology Corporation; Electronic Alloys; (12 pages), Jun. 1, 1995.

Sundar et al. "Soft Magnetic FeCo Alloys: Alloy Development, Processing, and Properties" International Materials Reviews, vol. 50, No. 3, pp. 157-192 (41 pages), 2005.

* cited by examiner

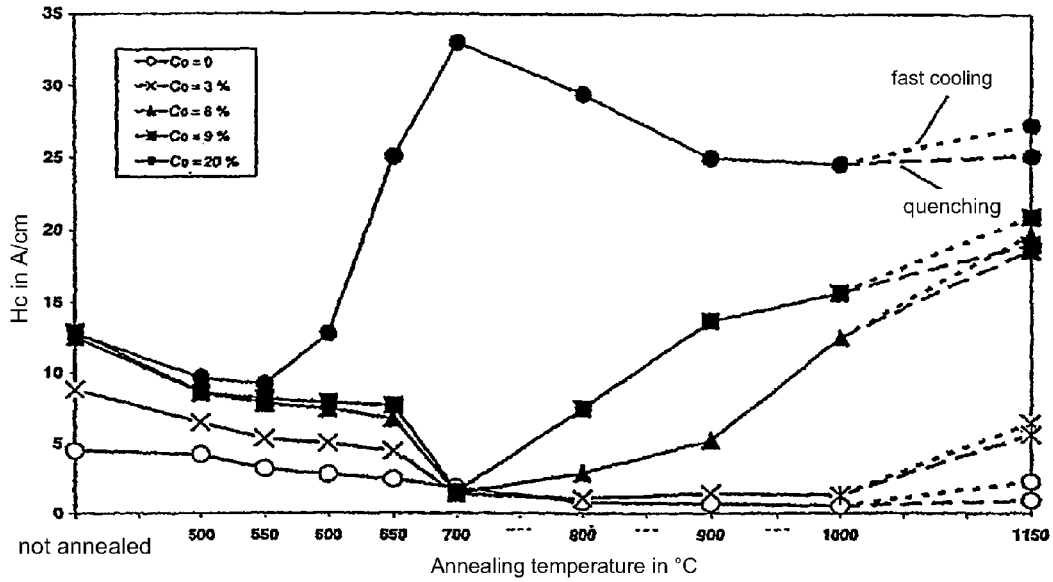
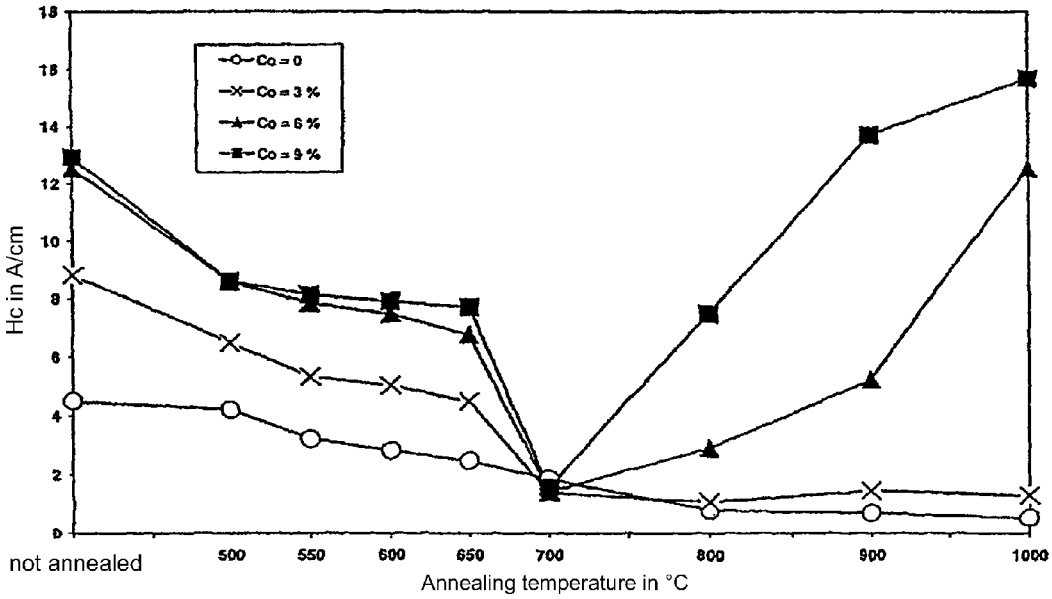
Fig. 2: dc-coercivity versus annealing temperature

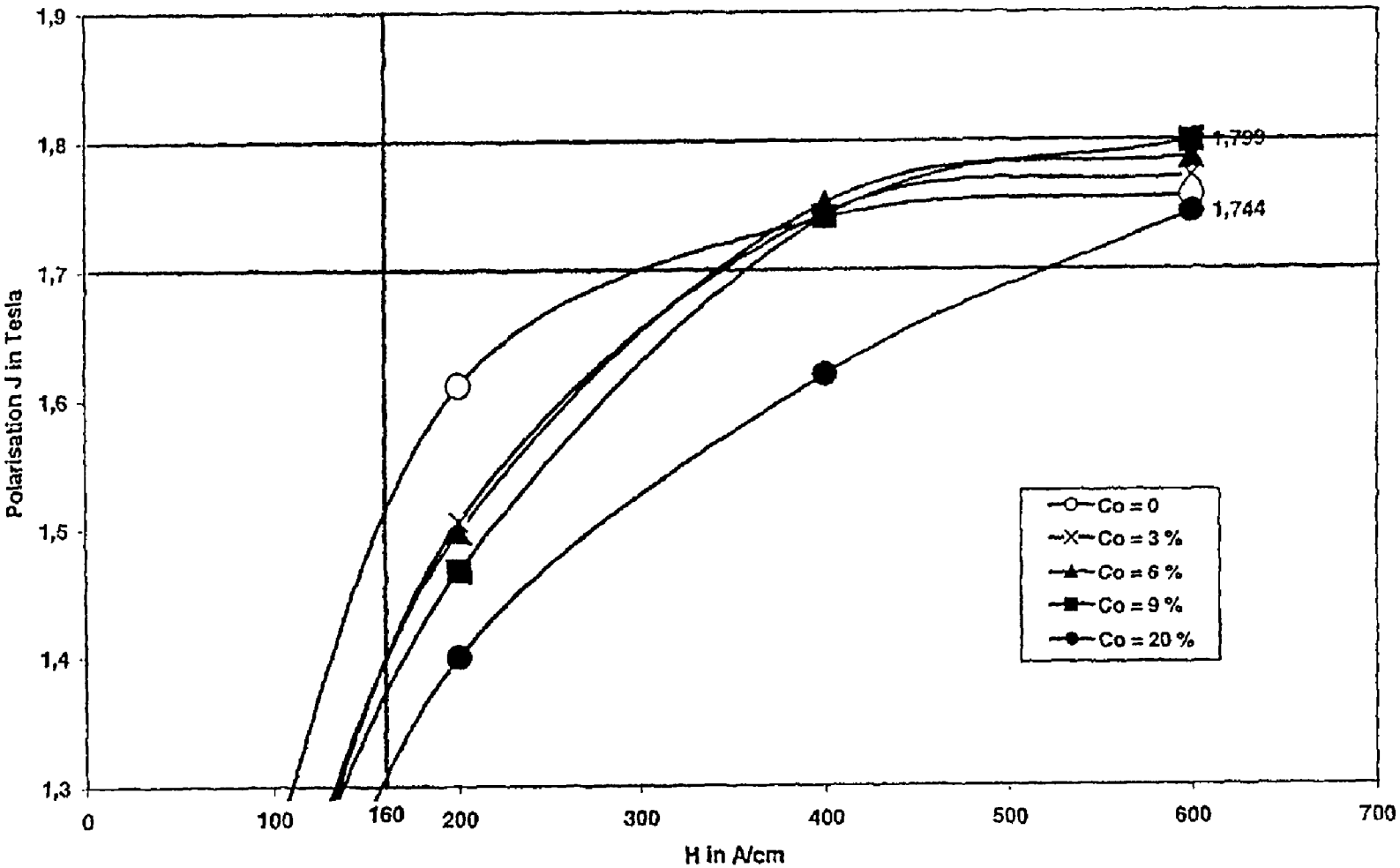
Fig. 3: dc virgin curve in the unannealed condition

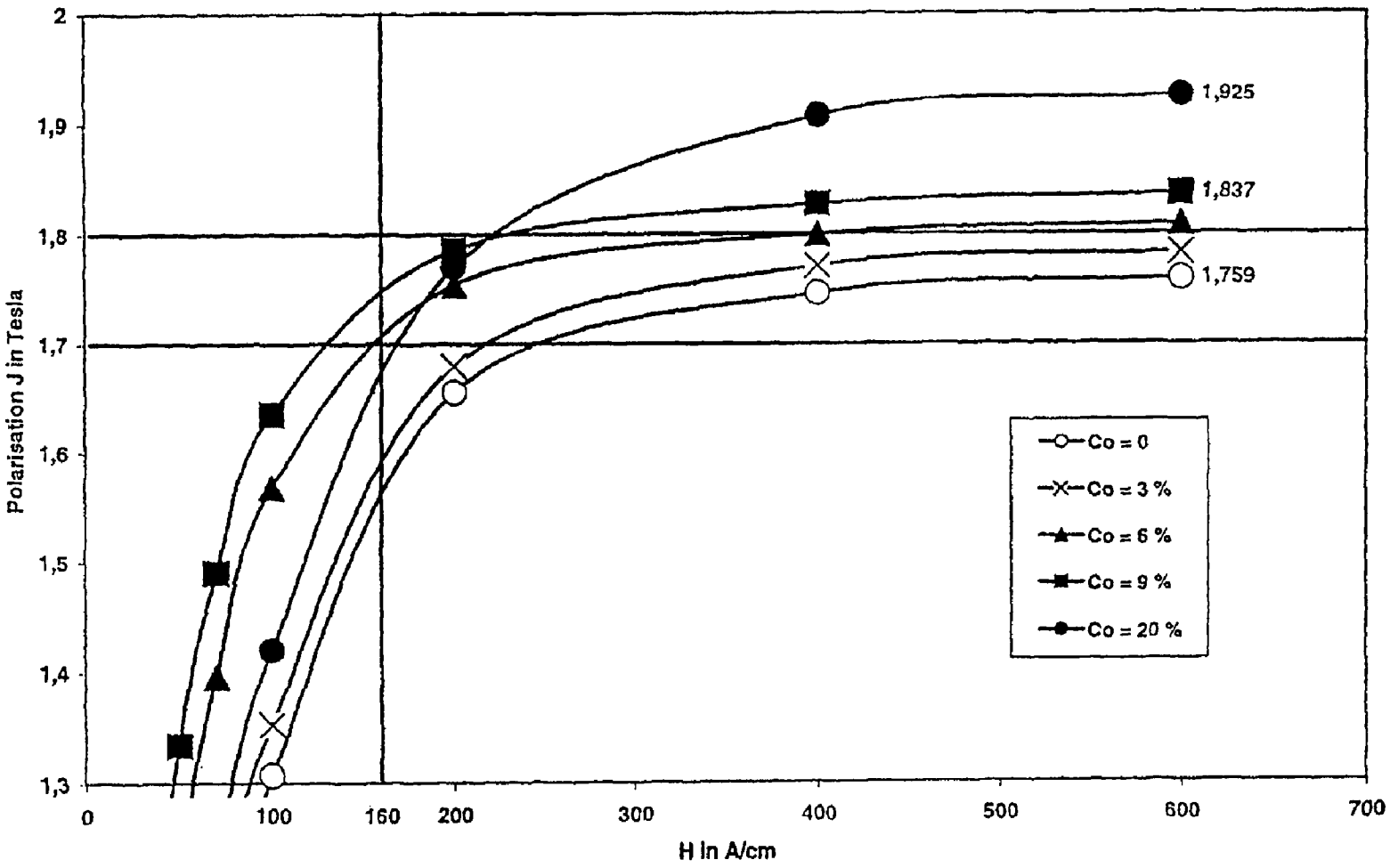
Fig. 4: dc virgin curve after 5 h annealing at 500 °C

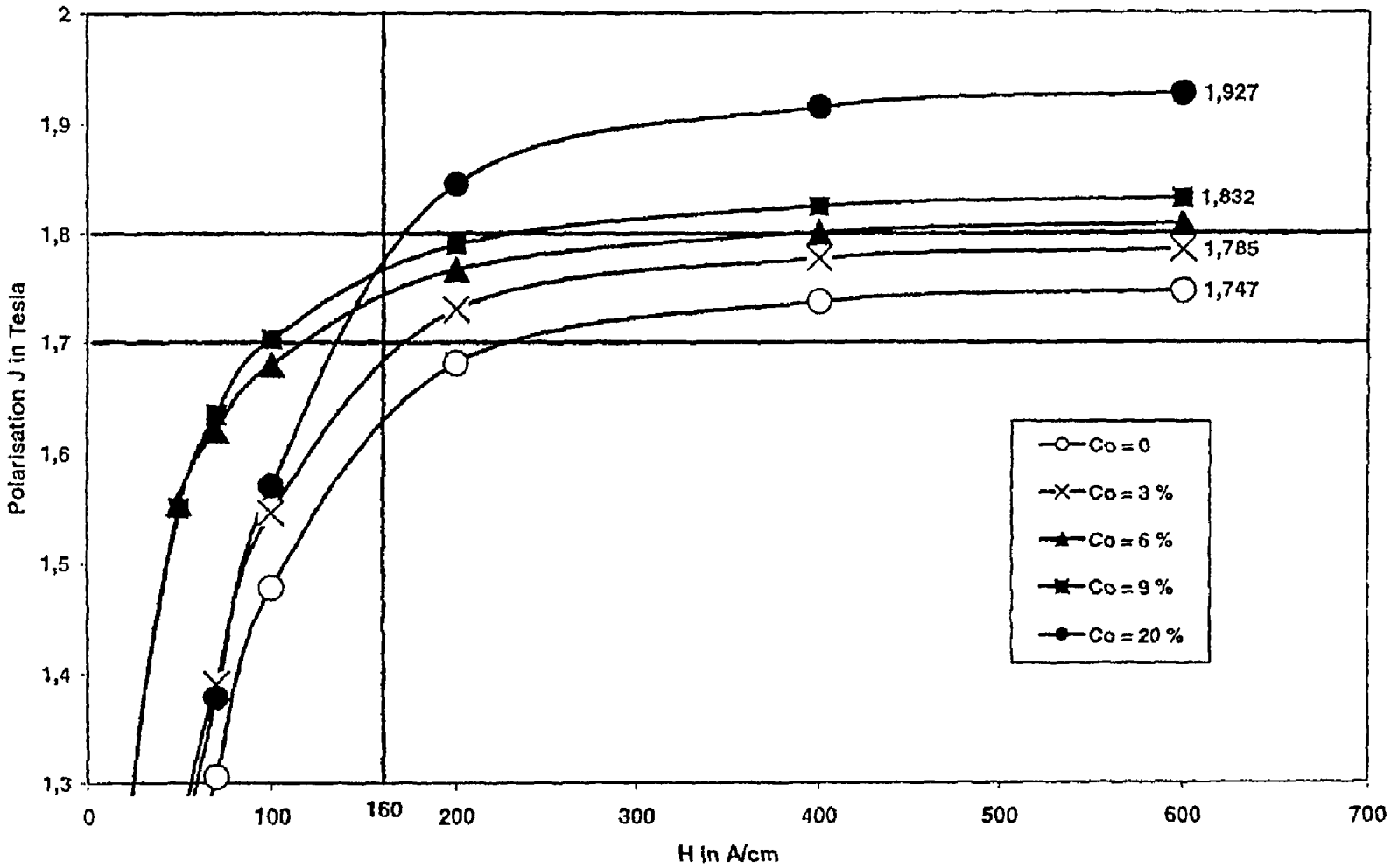
Fig. 5: dc virgin curve after 5 h annealing at 550 °C

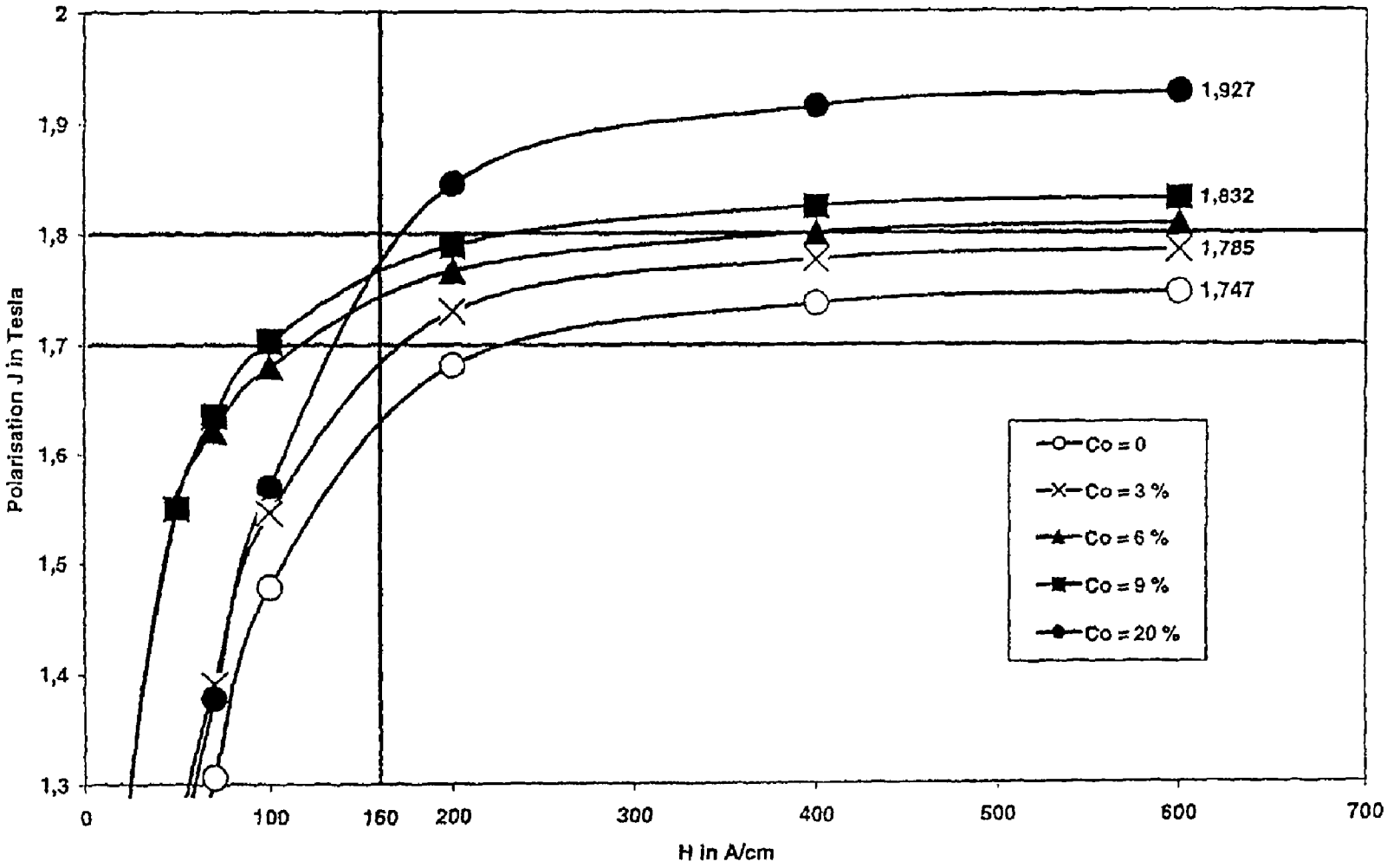
Fig. 6: dc virgin curve after 5 h annealing at 600 °C

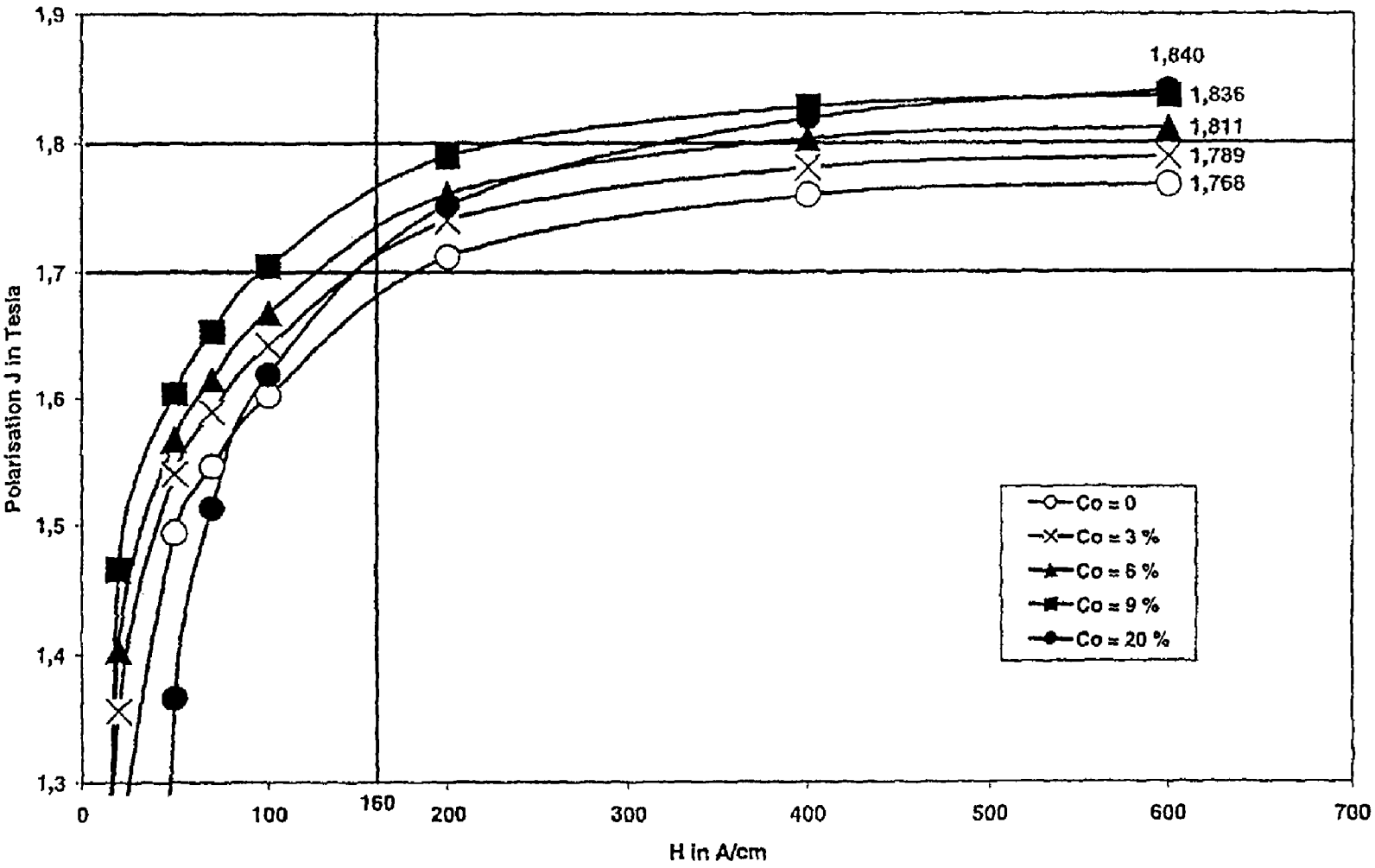
*Fig. 7:* dc virgin curve after 5 h annealing at 650 °C

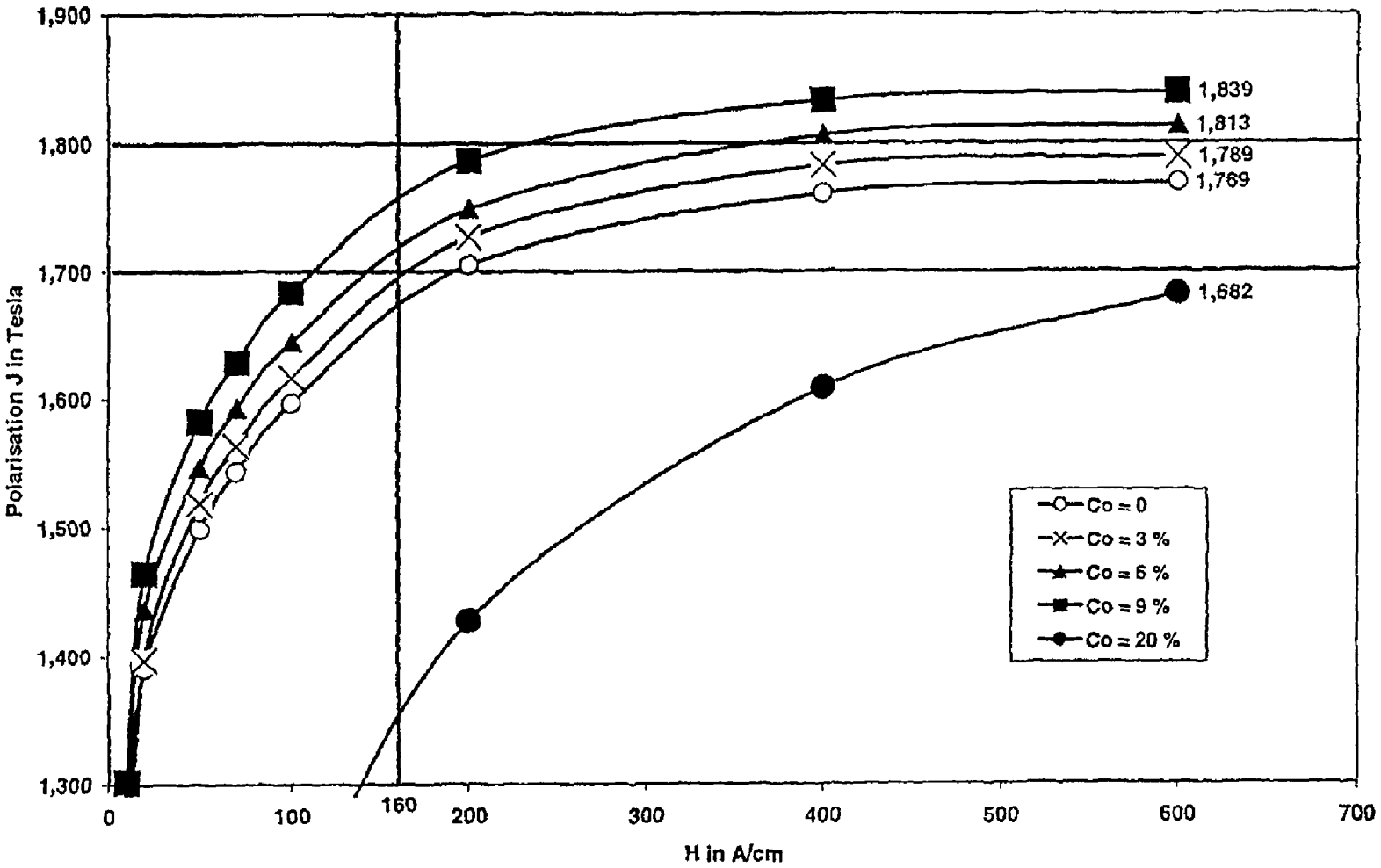
Fig. 8: dc virgin curve after 5 h annealing at 700 °C

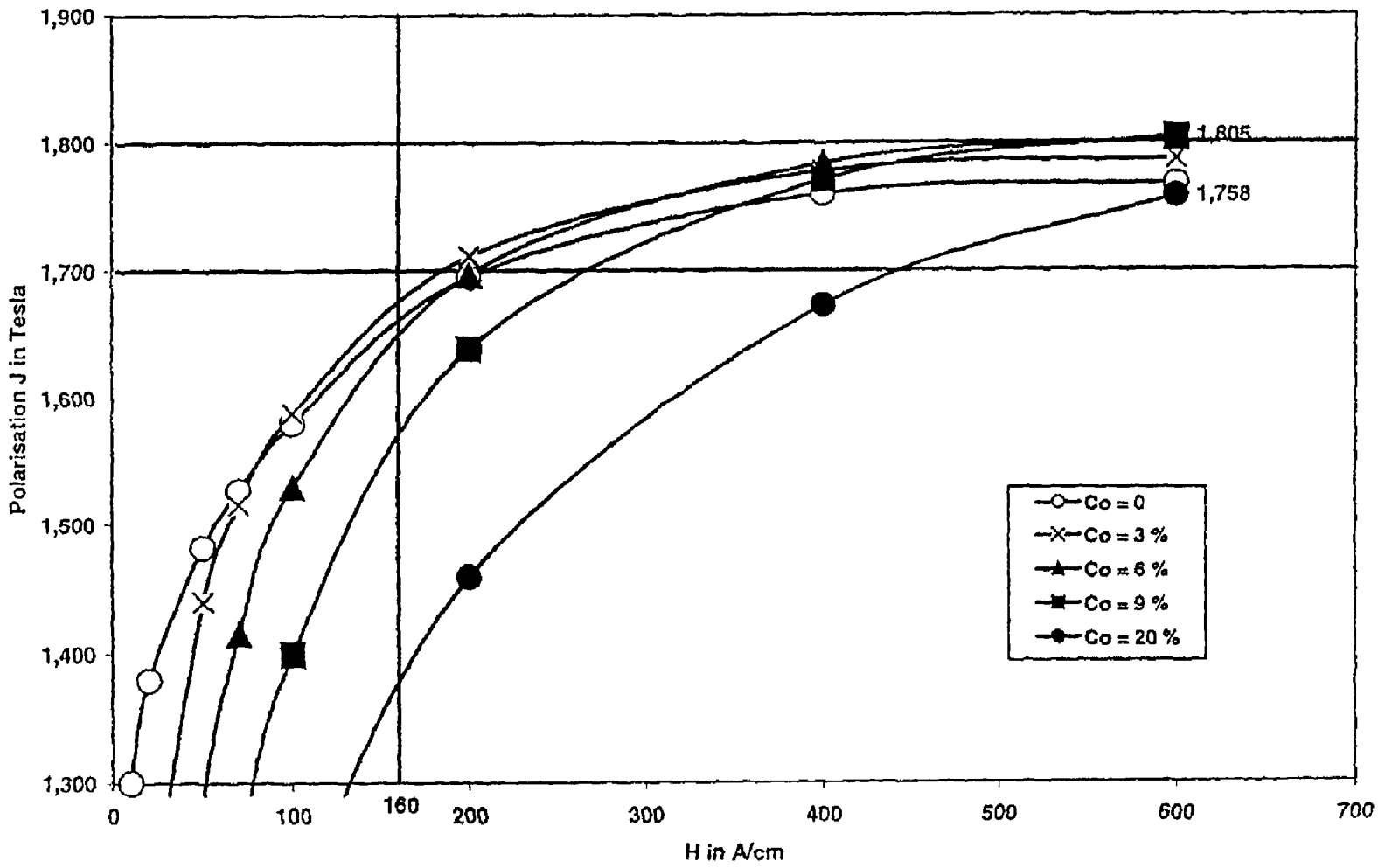
Fig. 9: dc virgin curve after 5 h annealing at 800 °C

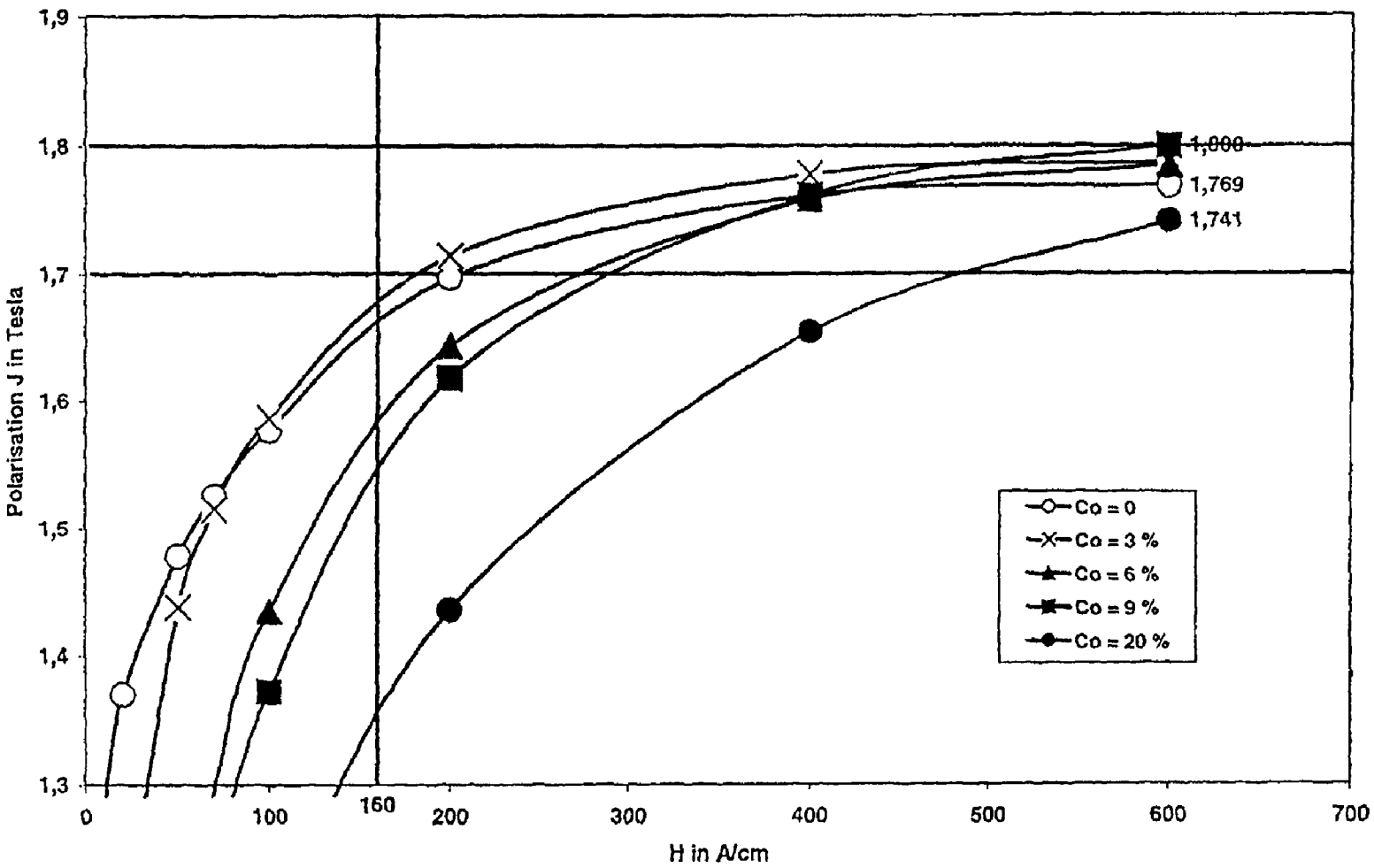
Fig. 10: dc virgin curve after 5 h annealing at 900 °C

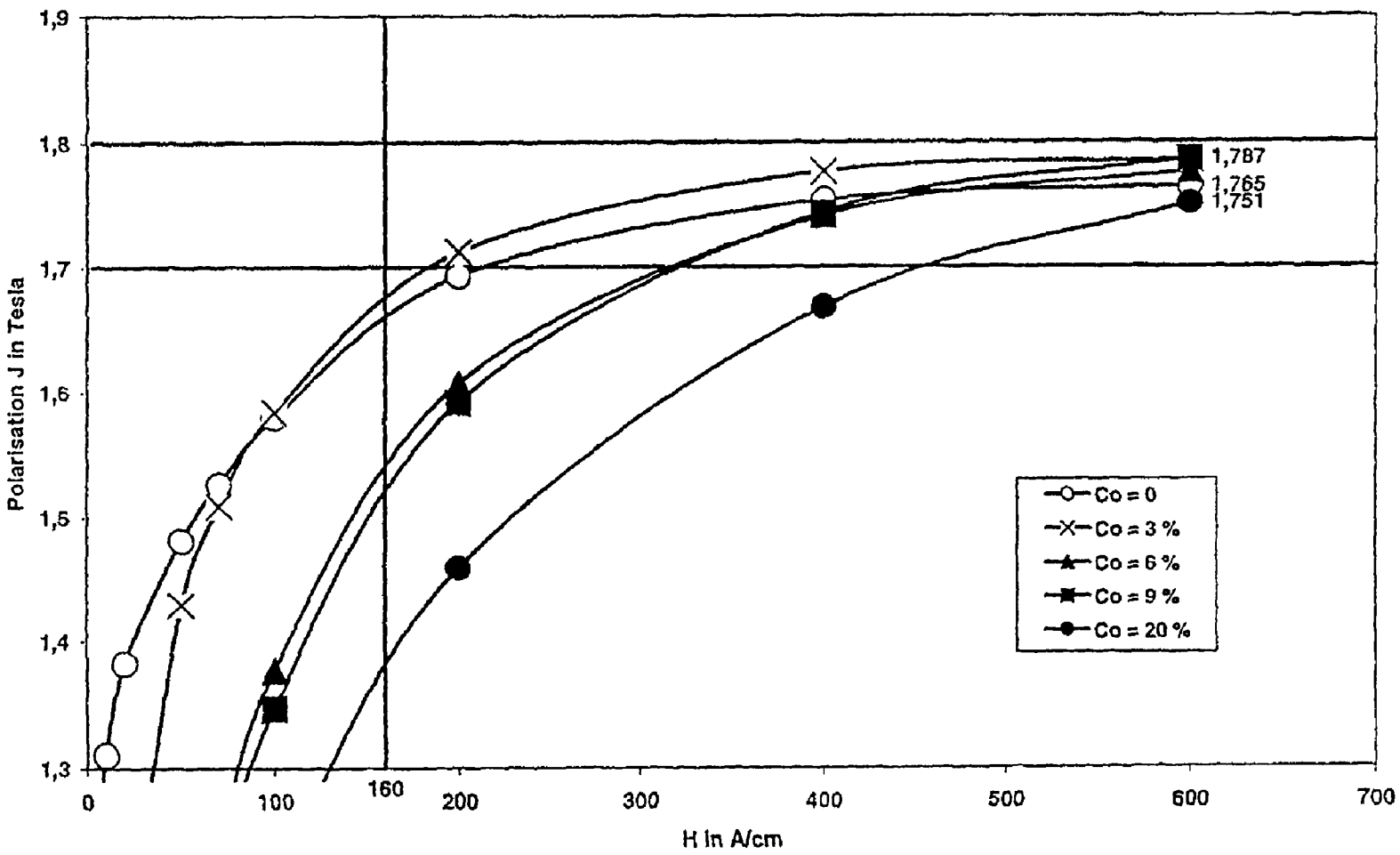
Fig. 11: dc virgin curve after 5 h annealing at 1000 °C

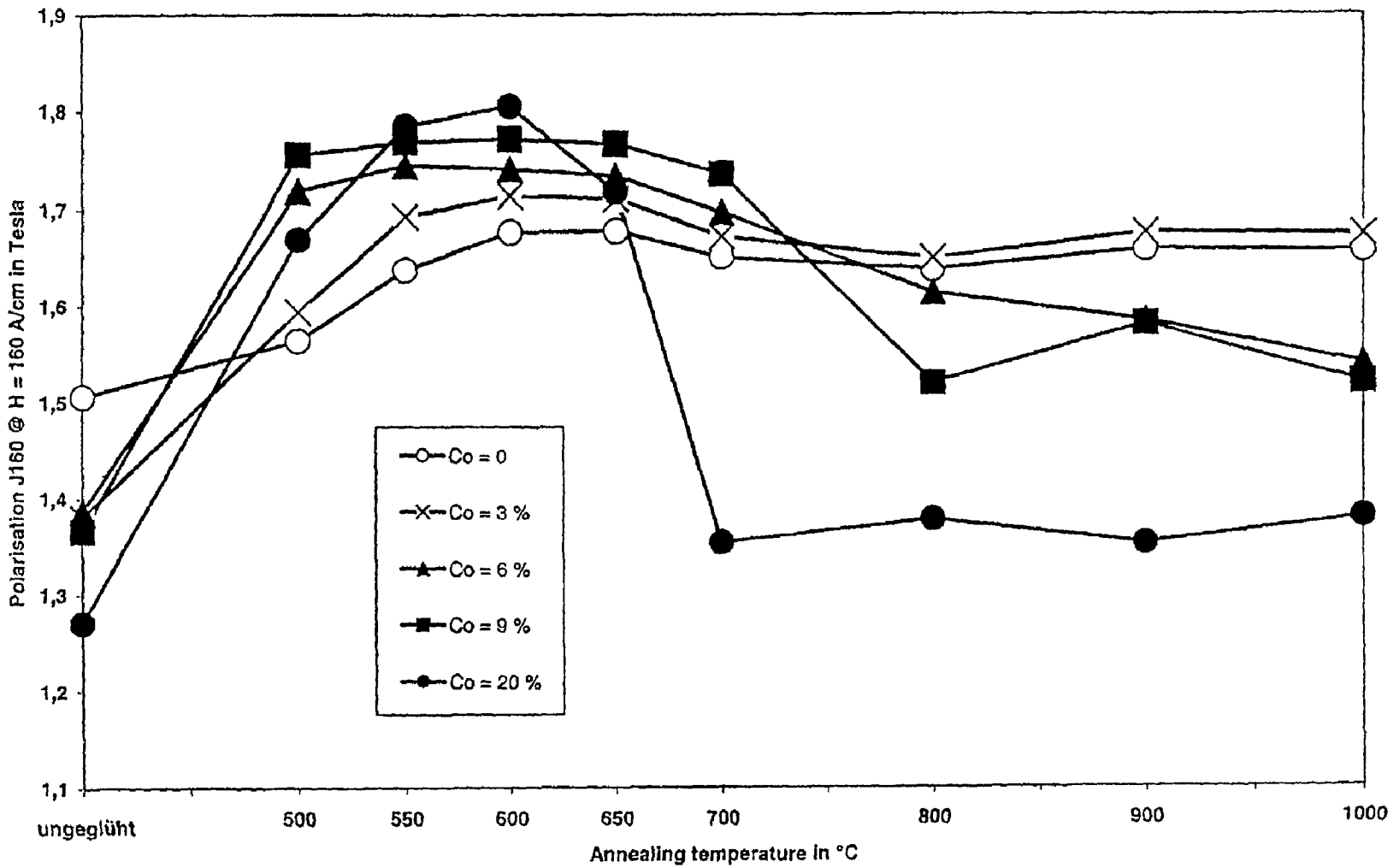
Fig. 12: Polarisation $J_{160}$ at H = 160 A/cm versus annealing temperature

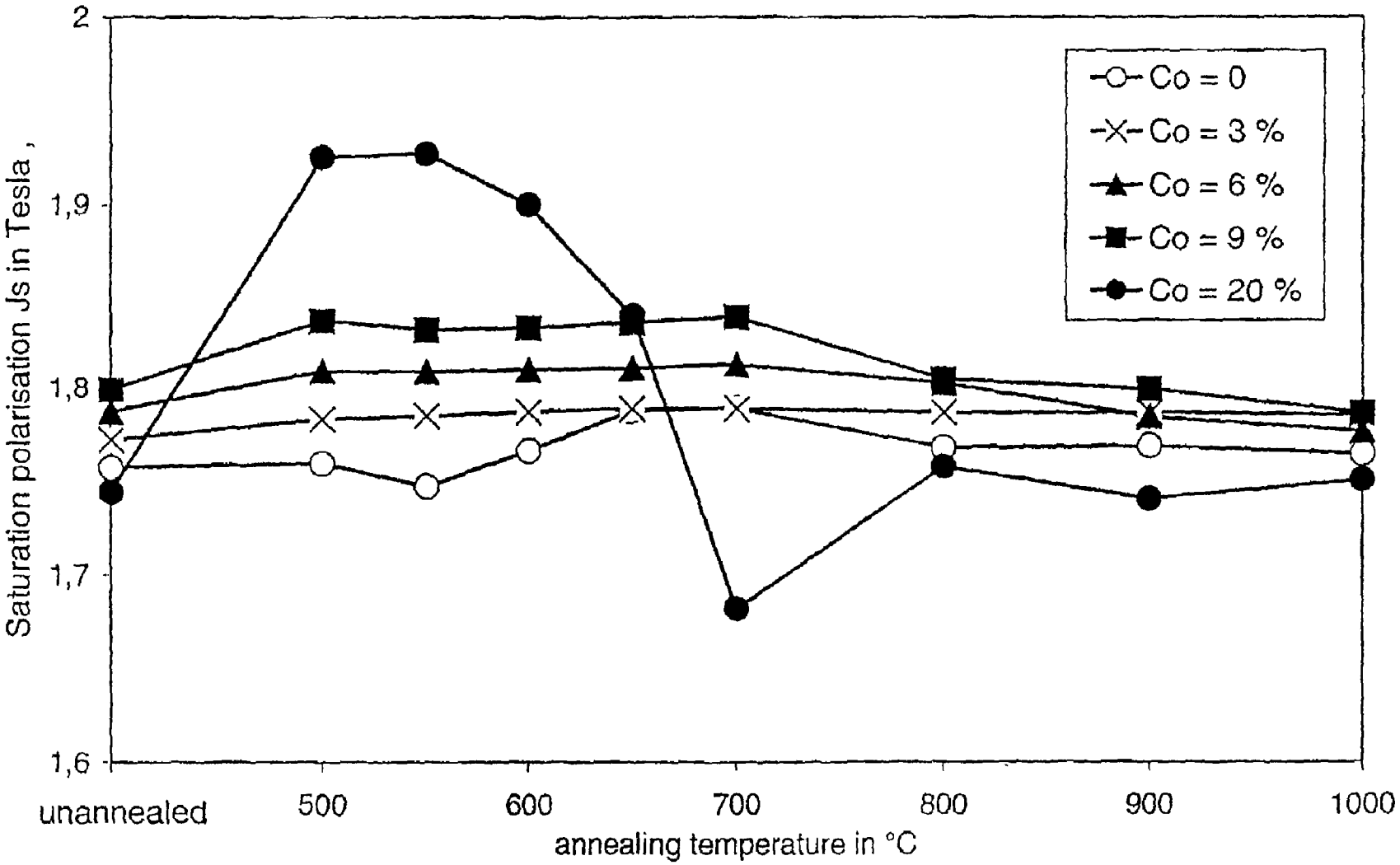
Fig. 13: Saturation polarisation $J_S$ at H = 600 A/cm versus annealing temperature

CORROSION RESISTANT MAGNETIC COMPONENT FOR A FUEL INJECTION VALVE

CROSS-REFERENCE TO RELATED APPLICATIONS

This application is a continuation-in-part of pending U.S. patent application Ser. No. 11/343,558 filed Jan. 31, 2006, the contents of which are hereby incorporated by reference in its entirety.

TECHNICAL FIELD

The invention relates to a corrosion resistant magnetic component, and in particular to a magnetic component for use in a magnetically actuated fuel injection valve which operates in a corrosive environment.

BACKGROUND

Magnetically actuated devices, such as solenoid valves are used in many types of systems including automotive applications such as fuel injection, anti-lock braking and active suspension systems.

Magnetically actuated devices typically include a magnetic coil and a moving magnetic core or plunger. In a typical arrangement of a solenoid valve 10, as shown in FIG. 1, the coil 22 surrounds the plunger 28 such that when the coil 22 is energized with electric current, a magnetic field is induced in the interior of the coil 22. The plunger 28 is formed of a soft magnetic material, typically a ferritic steel. A spring (not shown) holds the plunger 28 in a first position such that the device is either normally open or closed. When the coil 22 is energized, the induced magnetic field causes the plunger 28 to move to a second position to either close the device, if it is normally open, or open it, if it is normally closed.

It is desirable that the material used to make the magnetic core have good soft magnetic properties, principally, a low coercive field strength to minimize "sticking" of the component and a high saturation induction to minimize the size and weight of the component.

The plunger is often in direct contact with the local environment such as the fluid that is being controlled. Many environments and fluids are corrosive and will corrode the plunger, which may cause the device to malfunction or the valve to leak or become inoperative. It is, therefore, desirable that the plunger be formed of a material that has good resistance to the corrosive influence of the environment in which it is to be used.

The increasingly frequent use of magnetically actuated valves in automotive technologies as fuel injection systems has created a need for a magnetic material having improved corrosion resistance. The need for better corrosion resistance is of particular importance in automotive fuel injection systems in view of the introduction of more corrosive fuels such as those containing ethanol or methanol.

It is known to use ferritic steels for the magnetic component of fuel injection valves, but the corrosion resistance has been found to be insufficient in corrosive fuel environments.

SUMMARY

A magnetic component for a magnetically actuated fuel injection device which is suitable for use in corrosive fuel environments and, in particular, methanol-containing or ethanol-containing fuel mixtures can be provided according to an embodiment.

It is also desirable that the magnetic component has a saturation induction, a coercive field strength and an electrical resistivity which are sufficient for future requirements, in particular, for the fine control required by future fuel injection systems in order that the engine fulfils future environmental emissions legislation.

Additionally, it is desirable that the magnetic component is easily machined so that manufacturing costs are not increased and the components can be manufactured with the required tolerances and surface finish.

According to an embodiment, a magnetic component for a magnetically actuated fuel injection device can be formed of a corrosion resistant soft magnetic alloy consisting essentially of, in weight percent, $3\%<Co<20\%$, $6\%<Cr<15\%$, $0\%\leqq S\leqq 0.5\%$, $0\%\leqq Mo\leqq 3\%$, $0\%\leqq Si\leqq 3.5\%$, $0\%\leqq Al\leqq 4.5\%$, $0\%\leqq Mn\leqq 4.5\%$, $0\%\leqq Me\leqq 6\%$, where Me is one or more of the elements Sn, Zn, W, Ta, Nb, Zr and Ti, $0\%\leqq V\leqq 4.5\%$, $0\%\leqq Ni\leqq 5\%$, $0\%\leqq C<0.05\%$, $0\%\leqq Cu<1\%$, $0\%\leqq P<0.1\%$, $0\%\leqq N<0.5\%$, $0\%\leqq O<0.05\%$, $0\%\leqq B<0.01\%$, and the balance being essentially iron and the usual impurities.

BRIEF DESCRIPTION OF THE DRAWINGS

FIG. 10 Graph showing polarization J as a function of magnetic field H for samples annealed at 900° C. for 5 hours, FIG. 11 Graph showing polarization J as a function of magnetic field H for samples annealed at 1000° C. for 5 hours, FIG. 12 Graph showing polarization $J_{160}$ at a magnetic field H of 160 A/cm as a function of annealing temperature, FIG. 13 Graph showing saturation polarization $J_{600}$ at a magnetic field H of 600 A/cm as a function of annealing temperature, FIG. 14 Graph illustrating coercive field strength as a function of annealing temperature, FIG. 15 Graph illustrating coercive field strength as a function of annealing temperature, and FIG. 16 Graph illustrating coercive field strength as a function of annealing temperature.

Table 1 Table showing the composition of the batches of alloys according to various embodiments.

Table 2 Table showing coercive field strength, $H_c$, as a function of annealing temperature Table 3 Table showing the electrical resistivity, ρ, measured for samples with different Co-contents.

Table 4 Table showing a comparison of the magnetic and electrical parameters of the alloys according to various embodiments and commercially available alloys.

Table 5 Table showing the results of corrosion tests at 85° C. and 85% humidity.

Table 6 Table showing the results of corrosion tests in a gasoline/methanol/corrosive water solution.

Table 7 Table showing results of corrosion tests in a sulphate, nitrate and chloride-containing solution.

Figure 1:
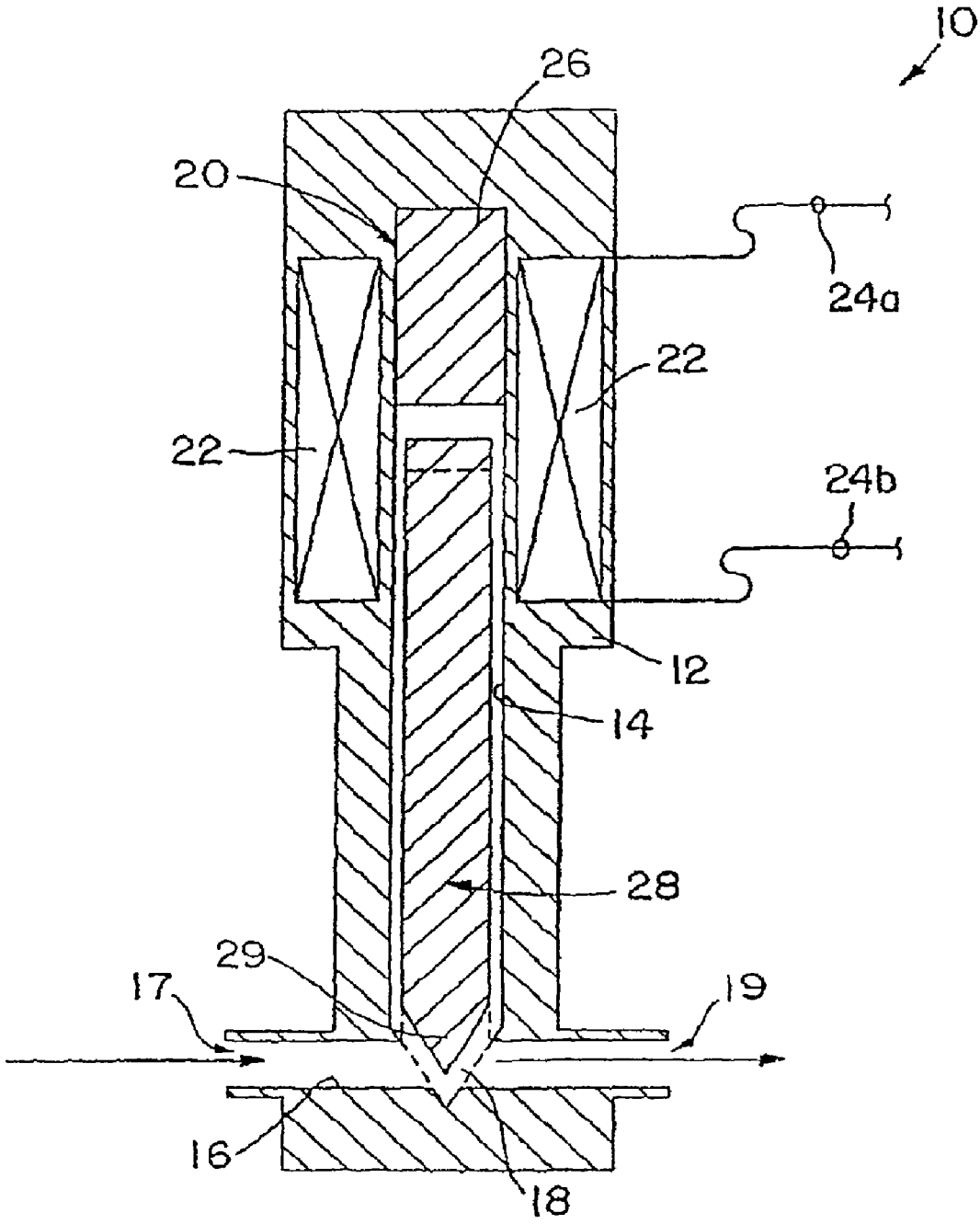
FIG. 1 Schematic diagram of a magnetically actuated solenoid valve known in the art, FIG. 2 Graph showing coercive field strength $H_c$ as a function of annealing temperature, FIG. 3 Graph showing polarization J as a function of magnetic field H for unannealed samples, FIG. 4 Graph showing polarization J as a function of magnetic field H for samples annealed at 500° C. for 5 hours, FIG. 5 Graph showing polarization J as a function of magnetic field H for samples annealed at 550° C. for 5 hours, FIG. 6 Graph showing polarization J as a function of magnetic field H for samples annealed at 600° C. for 5 hours, FIG. 7 Graph showing polarization J as a function of magnetic field H for samples annealed at 650° C. for 5 hours, FIG. 8 Graph showing polarization J as a function of magnetic field H for samples annealed at 700° C. for 5 hours, FIG. 9 Graph showing polarization J as a function of magnetic field H for samples annealed at 800° C. for 5 hours.
Figure 14:
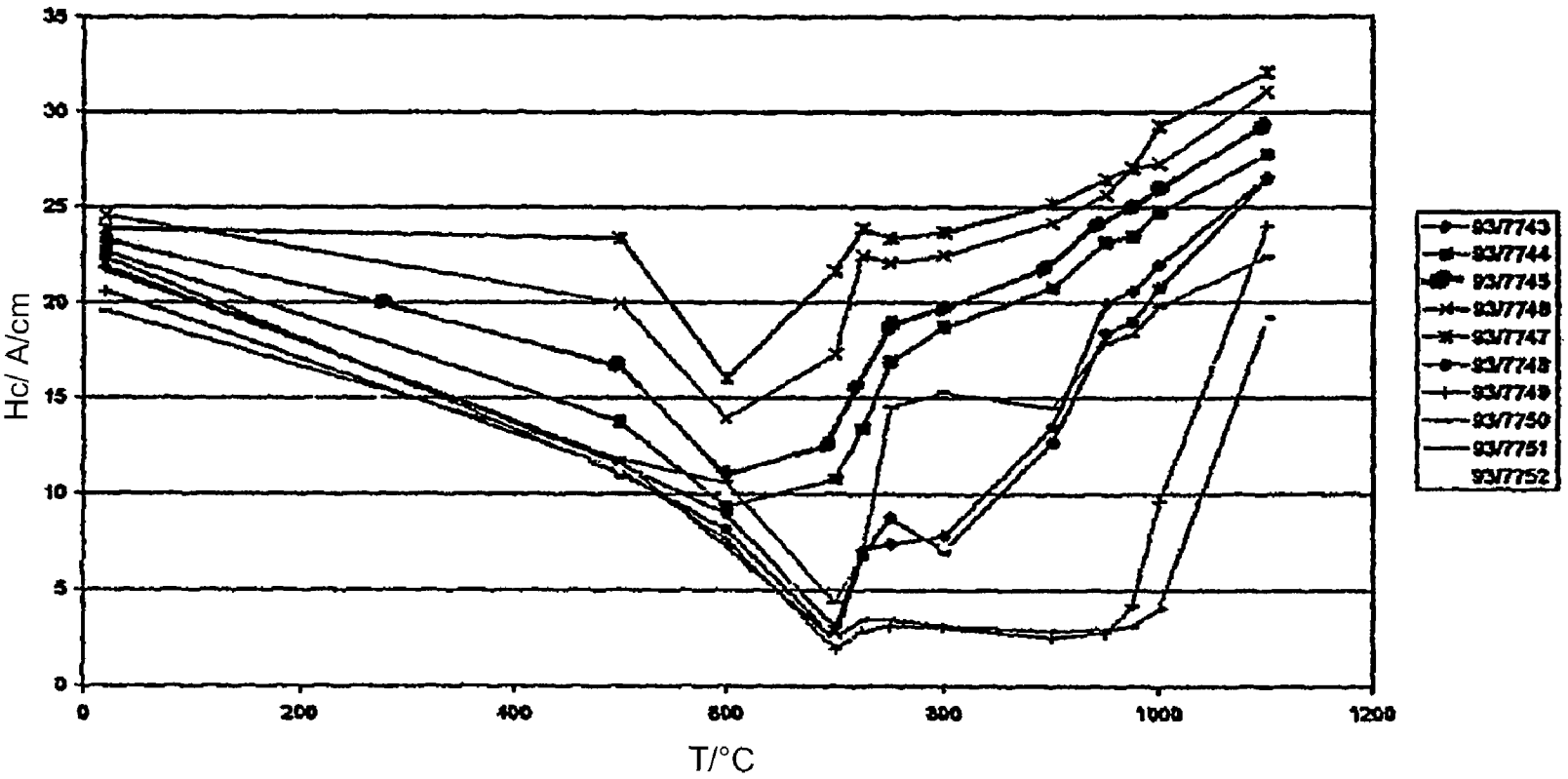

Table 8 Table showing the composition of the alloys illustrated in FIG. 14.

Figure 15:
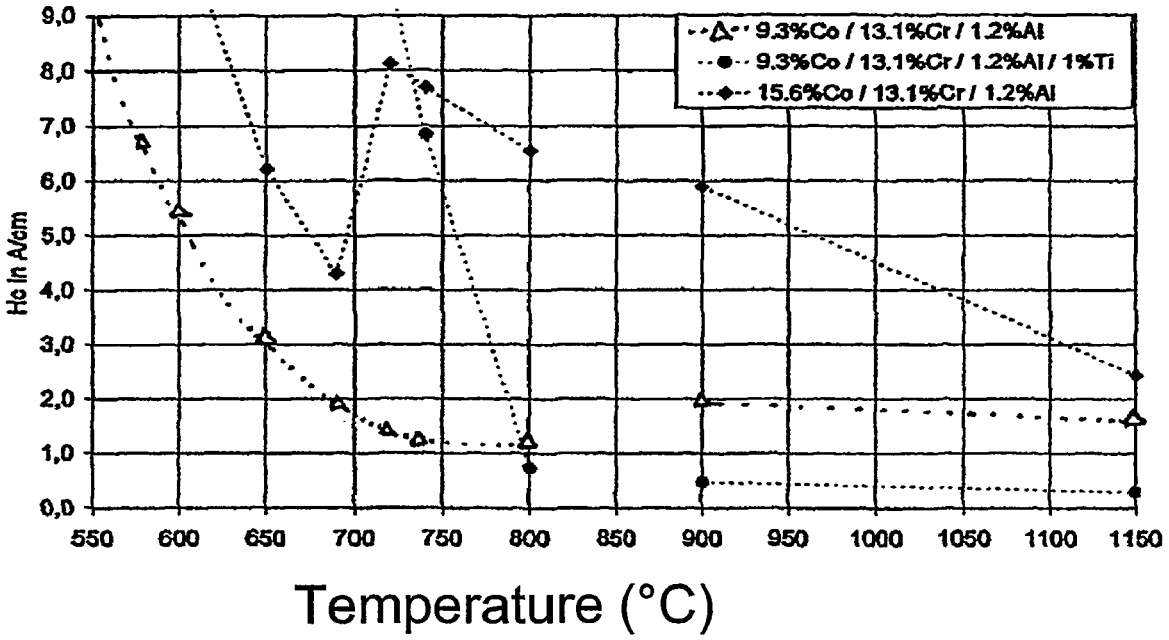

Table 9 Table showing the composition of the alloys illustrated in FIG. 15.

Figure 16:
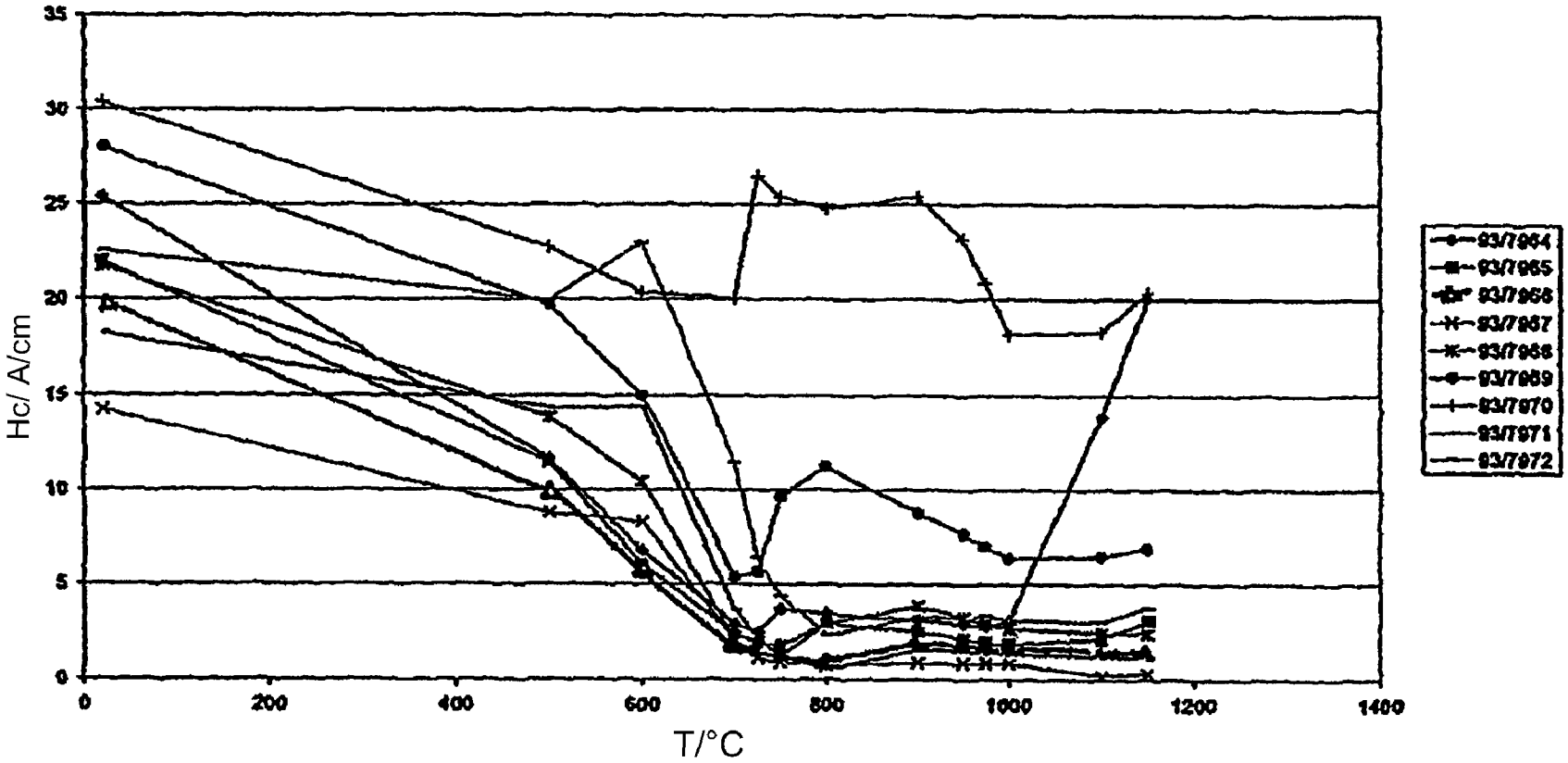

Table 10 Table showing the composition of the alloys illustrated in FIG. 16.

DETAILED DESCRIPTION

The magnetic component according to various embodiments has excellent corrosion resistance in corrosive fuel environments and soft magnetic properties suitable for a magnetically actuated fuel injection valve, in particular a high saturation polarization, $J_s$, low coercive field strength, $H_c$, and a high resistivity, ρ. The magnetic component also has good machining properties.

In this description, all compositions are given in weight percent, wt %.

In further embodiments, the Co-content of the magnetic component lies in the ranges 6%<Co<16% or 10.5%<Co<18.5%. For applications in which a high $J_s$ is desirable, a higher Co content may be provided. Since Cobalt is a relatively expensive element, it may desirable to use a lower cobalt content for applications in which it is desired to reduce the materials cost.

The alloy may contain 0.01%≦Mn≦1% and 0.005%≦S≦0.5% or 0.01%≦Mn≦0.1% and 0.005%≦S≦0.05%. In a further embodiment, the ratio of manganese to sulphur, Mn/S, is ≧1.7. The provision of manganese and sulphur additions within these ranges further improves the free machining properties of the alloy. The alloy may comprise Titanium in the place of manganese and, therefore, may contain 0.01%≦Ti≦1% by weight. Ti also improves the free machining properties of the alloy and has the additional advantage that it improves the magnetic properties and corrosions resistance of the alloy.

The sum of Cr and Mo may lie in the range 11%≦Cr+Mo≦19% and in a further embodiment, the sum of Si+1.3Al+1.3Mn+1.7Sn+1.7Zn+1.3V≦3.5%.

The polarization J of the magnetic component at a magnetic field H of 160 A/cm may be greater than 1.6 T or greater than 1.7 T. The saturation polarization JS of the magnetic component at a magnetic field H of 600 A/cm may be greater than 1.75 T or greater than 1.8 T. A high value of the saturation polarization $J_s$ enables the size and weight of the magnetic component to be reduced.

The magnetic component may have an electrical resistivity, ρ, which is greater than 0.4 μΩm or greater than 0.5 μΩm or greater than 0.58 μΩm. A higher value of resistivity, ρ, leads to a reduction in eddy currents after the magnetic field is applied or removed to the magnetic component. Damping of the eddy currents improves the responsiveness of the device. This can be advantageously used in optimization of the control of the fuel injection device at high engine revolutions.

In a further embodiment, a magnetic component for a magnetically actuated fuel injection device is formed of a corrosion resistant soft magnetic alloy consisting essentially of, in weight percent, 9%<Co<20%, 6%<Cr<15%, 0%≦S≦0.5%, 0%≦Mn≦4.5%, 0%≦Al≦2.5%, 0%≦V≦2.0%, 0%≦Ti≦2.0%, 0%≦Mo≦2.0%, 0%≦Si≦3.5%, 0%≦C<0.05%, 0%≦P<0.1%, 0%≦N<0.5%, 0%≦O<0.05%, 0%≦B<0.01%, and the balance being essentially iron and the usual impurities and comprises at least one of the elements Al, V, Ti and Mo This magnetic component comprises at least one of the elements aluminium, vanadium, titanium and molybdenum. These elements each or in combination have the effect of increasing the phase transition temperature, i.e. the temperature at which the alloy enters a non-ferritic phase. Alloys according to this embodiment may be annealed at higher temperatures than those without additions of at least one of aluminium, vanadium, titanium and molybdenum.

In a further embodiment, the alloy comprises at least one of the elements Al, V, Ti and Mo in the range of 0.2 weight percent to 2.0 weight percent.

In further embodiments, the alloy comprises 0.2%≦Al≦2.0%, Ti=0%, V=0% and Mo0=%, 0.2%≦Ti≦2.0%, V=0% Al=0% and Mo=0% or 0.2%≦V≦2.0%, Ti=0%, Al0=0% and Mo=0% or 0.2%≦Mo≦2.0%, V=0%, Al0=% and Ti=0%.

In further embodiments, the alloy comprises 0.2%≦Al≦2.0%, 0.2%≦Ti≦2.0%, V=0% and Mo=0% or 0.2%≦Al≦2.0%, 0.2%≦V≦2.0%, Ti=0% and 0.2%≦Al≦2.0%, Mo=0% or 0.2%≦Mo≦2.0%, V=0% and Ti=0%.

These combinations of Al and Ti, Al and V and Al and Mo have been found to produce advantageous increases in the annealing temperature which can be used without causing a large degradation in the magnetic properties as exemplified by a values of the coercive field strength $H_c$ of less than 7 A/cm or of less than 5 A/cm.

The fuel injection device, according to various embodiments, may be used in a gasoline engine or a diesel engine. In this context, gasoline engine is used to denote an engine designed to operate with a gasoline fuel supply and diesel engine is used to denote an engine designed to operate with a diesel fuel supply.

The fuel injection site and the environment under which the fuel injection device operates, for example pressure and engine revolutions, is different in gasoline engines and diesel engines. The corrosiveness of the environment in which the magnetic component of the fuel injection device operates may, therefore, differ in addition to the desired magnetic and electrical properties of the magnetic component. Therefore, the composition most suitable for a fuel injection device for a gasoline engine and the composition most suitable for a fuel injection device for a diesel engine may differ although both compositions lie within the ranges of the invention. In a further embodiment, the fuel injection device is a direct fuel injection valve.

According to an embodiment, the magnetic component is for use in an environment comprising a mixture of fuel and an alcohol, wherein the fuel is one of gasoline and diesel. Fuel mixtures including an alcohol are known to be extremely corrosive. These fuel mixtures may also comprise a small quantity of water in a form commonly described as corrosive water.

In further embodiments, the mixture comprises 90% gasoline and 10% alcohol or 85% gasoline and 15% alcohol or 80% gasoline and 20% alcohol or 15% gasoline and 85% ethanol (also known as E85) or 85% gasoline and 15% ethanol (also known as E15).

The alcohol may comprise methanol, ethanol, propanol, butanol or a mixture of two or more of methanol, ethanol, propanol and butanol.

Fuel mixtures of gasoline and alcohol are often found to be more corrosive than fuel mixtures of diesel and alcohol. Consequently, a composition particularly suitable for use in a gasoline/alcohol fuel mixture environment and a composition particularly suitable for use in a diesel/alcohol fuel mixture environment may differ although both compositions lie within the ranges defined by the invention.

In an embodiment, the alcohol is methanol. In further embodiments, the mixture comprises 90% gasoline and 10% methanol or 85% gasoline and 15% methanol or 80% gasoline and 20% methanol.

In an embodiment, the alcohol is ethanol. In further embodiments, the mixture comprises 90% gasoline and 10% ethanol or 85% gasoline and 15% ethanol or 80% gasoline and 20% ethanol.

Similarly, fuel mixtures of gasoline and methanol or ethanol are often found to be more corrosive than fuel mixtures of diesel and methanol or ethanol. For example, a composition particularly suitable for use in a gasoline/methanol fuel mixture environment and a composition particularly suitable for use in a diesel/methanol fuel mixture environment may differ although both compositions lie within the ranges defined by the invention.

Five FeCrCo-based alloys of differing composition were fabricated by melting and casting 5 kg of each composition. Each alloy comprised 13 wt % chromium and the cobalt content was varied from 0 wt % to 20 wt %. The composition of each of the five batches is listed in table 1.

TABLE 1

| Batch No. | Fe (wt %) | Co (wt %) | Cr (wt %) |
|---|---|---|---|
| 93/7215 | rest | 0 | 13 |
| 93/7216 | rest | 3 | 13 |
| 93/7217 | rest | 6 | 13 |
| 93/7218 | rest | 9 | 13 |
| 93/7342 | rest | 20 | 13 |

Each of the cast blocks was turned to a diameter of 40 mm. The blocks were heated to a temperature of 1200° C. and then hot rolled to a diameter of approximately 12 mm. The samples were then etched in hydrochloric acid and aqua regia.

Each sample was swaged from a diameter of 12 mm to a diameter in the range of 10.47 mm to 10.66 mm. The rods were then degreased and cold-drawn to a diameter of 10 mm. From each of these rods, ten measurement samples, each with a length of 100 mm, were cut for annealing experiments and magnetic measurements. From each alloy composition, a measurement sample was annealed at a temperature between 500° C. and 1150° C. in a hydrogen atmosphere for five hours.

The coercive field strength $H_c$ (A/cm) was measured for each of the compositions and annealing temperatures and the results are summarised in table 2 and FIG. 2.

TABLE 2

| Annealing temperature (° C.) | 93/7215 Co = 0 wt % | 93/7216 Co = 3 wt % | 93/7217 Co = 6 wt % | 93/7218 Co = 9 wt % | 93/7342 Co = 20 wt % |
|---|---|---|---|---|---|
| unannealed | 4.50 | 8.82 | 12.54 | 12.93 | 12.81 |
| 500 | 4.21 | 6.49 | 8.59 | 8.61 | 9.64 |
| 550 | 3.21 | 5.33 | 7.85 | 8.14 | 9.21 |
| 600 | 2.81 | 5.03 | 7.47 | 7.90 | 12.80 |
| 650 | 2.46 | 4.47 | 6.76 | 7.70 | 25.10 |
| 700 | 1.85 | 1.38 | 1.42 | 1.57 | 33.00 |
| 800 | 0.79 | 1.07 | 2.90 | 7.49 | 29.40 |
| 900 | 0.69 | 1.44 | 5.22 | 13.71 | 25.00 |
| 1000 | 0.53 | 1.29 | 12.55 | 15.69 | 24.60 |

A low value of $H_c$ is desired for the magnetic component of magnetically actuated devices. $H_c$ is inversely proportional to the permeability, μ. A high permeability leads to a reduction in the electric current required to achieve a given flux density. A low value of $H_c$ permits rapid magnetization and demagnetization and enables the valve to be quickly opened and closed. This is particularly desirable in fuel injection systems and in particular for fuel injection systems for petrol motors where the rpm of the engine is high.

As can be seen in table 2 and FIG. 2, for samples with 0 wt % to 9 wt % Co, the coercive field strength, $H_c$, was observed to decrease with increasing annealing temperature and the lowest value is reached at around 700° C. For annealing temperatures of above 700° C., the coercive field strength, $H_c$, was found to increase by a different amount depending on the cobalt content. For temperatures above 700° C., the coercive field strength of the alloy without cobalt reduces further whereas, for the Co-containing samples, $H_c$ was observed to increase with increasing Co-content.

However, the batch with a Cobalt content of 20 wt % shows a different type of behaviour. For this composition, the lowest value of the coercive field strength, $H_c$, was reached at an annealing temperature of 550° C. For higher annealing temperatures, the coercive field strength, $H_c$, increases to over 30 A/cm after annealing at 700° C. and then decreases again with increasing temperature for annealing temperatures between 700° C. and 1000° C.

The polarisation J for applied magnetic fields H of up to 600 A/cm was measured for samples of each of the compositions and each of the annealing temperatures. The results of these experiments are shown in FIGS. 3 to 11.

The relationship between the polarisation at a measurement magnetic field of 160 A/cm ($J_{160}$) and the annealing temperature is summarized in FIG. 12 for each of the alloy compositions.

The relationship between the saturation polarisation $J_s$ at a measurement magnetic field of 600 A/cm ($J_{600}$) and the annealing temperature is summarized in FIG. 13 for each of the alloy compositions.

A high value of $J_s$ is desirable so that the size and weight of the magnetic component may be reduced. For a magnetic field of 160 A/cm, a value of $J_{160}$ of above 1.7 T is observed for the alloys with a cobalt content of 6 wt % and 9 wt % and an annealing temperature of 650° C. and 700° C.

The electrical resistivity, ρ, was also measured for each of the batches and is shown in table 3. It is desirable that the electrical resistivity be as high as possible to dampen eddy currents and improve the responsiveness of the device. The resistivity, ρ, was measured to increase from 0.428 μΩm for the alloy containing 0 wt % cobalt to 0.768 μΩm for the alloy containing 20 wt % cobalt.

TABLE 3

| Batch No. | Co content (wt %) | Resistivity (μΩm) |
|---|---|---|
| 93/7215 | 0 | 0.428 |
| 93/7216 | 3 | 0.485 |
| 93/7217 | 6 | 0.539 |
| 93/7218 | 9 | 0.582 |
| 93/7342 | 20 | 0.768 |

The alloy comprising 9 wt % Co, 13 wt % Cr, rest Fe showed the best soft magnetic characteristics for annealing conditions of 700° C. for five hours. The highest saturation polarisation value, $J_s$, also the polarization at a field of 160 A/cm, $J_{160}$, was also attained for this composition and the coercive field strength, $H_c$, which lies at 1.57 A/cm is also reasonably low. The resistivity is increased to 0.582 μΩm which is advantageous for the dynamics of fuel injection valves.

Table 4 compares the values of $H_c$, $J_s$, $J_{160}$, μ and ρ for a composition of 13 wt % Cr, 9 wt % Co, rest Fe with the composition 0 wt % Co, 13 wt % Cr, rest Fe, commercially available pure Fe (VACOFER S1) and a commercially available FeCo alloy (VACOFLUX 17) of composition 17 wt % Co, 2 wt % Cr, 1 wt % Mo, rest Fe.

TABLE 4

| Alloy | $H_c$ (A/cm) | $J_s$ (T) | $J_{160}$ (T) | μ (max) | ρ (μΩm) |
|---|---|---|---|---|---|
| 93/7218 (13 wt % Cr, 9 wt % Co, rest Fe) | 1.57 | 1.84 | 1.767 | 1,320 | 0.58 |
| 93/7215 (13 wt % Cr, 0 wt % Co, rest Fe) | 0.53 | 1.765 | 1.657 | 1,788 | 0.43 |
| VACOFLUX 17 | ≦2.0 | 2.22 | >2.0 | 2,500 | >0.39 |
| VACOFER S1 | ≦0.12 | 2.15 | 1.97 | 40,000 | 0.10 |

As shown in table 4, an alloy comprising 9 wt % Co, 13 wt % Cr, rest Fe has a value of saturation polarisation at a field of 160 A/cm, $J_{160}$, which is approximately 0.1 T higher than that observed for a binary alloy comprising 13 wt % Cr, rest Fe. The resistivity is also increased by around 0.15 μΩm over that measured for the binary alloy comprising 13 wt % Cr, rest Fe.

The composition of 9 wt % Co, 13 wt % Cr, rest Fe has a higher resistivity, but a slightly lower $H_c$, $J_s$ and $J_{160}$ compared to pure Fe. However, as will be seen in the results from the corrosion experiments, the corrosion resistance of the 13 wt % Cr, 9 wt % Co, rest Fe is significantly improved over that of pure Fe.

The corrosion resistance of the five batches in addition to two commercially available alloys (VACOFLUX 17 and VACOFLUX 50 (49 wt % Co, 2 wt % V, rest Fe)) were investigated. In a first test, pieces of each batch were subjected to an environmental test at 85° C. and 85% humidity. The results of observational examination are summarised in table 5.

TABLE 5

| Alloy | Observable change (after 14 days) |
|---|---|
| VACOFLUX 17 | Black corrosion product on the side faces |
| VACOFLUX 50 | Two small rust spots on the surface |
| 93/7215 (0 wt % Co) | Black corrosion product on the side faces |
| 93/7216 (3 wt % Co) | No change observed |
| 93/7217 (6 wt % Co) | No change observed |
| 93/7218 (9 wt % Co) | No change observed |
| 93/7342 (20 wt % Co) | A little darker |

After 14 days exposure, the alloys with cobalt contents of between 3 wt % and 9 wt % did not show any signs of corrosion.

The corrosion behaviour of the alloys was also investigated for a gasoline/methanol/water environment. A solution comprising 84.5% gasoline, 15% methanol and 0.5% corrosive water was prepared. The corrosive water comprised 16.5 mg of sodium chloride per liter, 13.5 mg of sodium hydrogen carbonate per liter, and 14.8 mg of Formic acid. The samples were immersed in the solution for 150 hours at 130° C. The results of this test are shown in table 6. The tests were optically observed under an optical microscope at a magnification of 16 times. Samples with 0 wt %, 3 wt % and 9 wt % cobalt respectively were not observed to show any signs of corrosion.

TABLE 6

| Alloy | Observable change (after 150 hours at 130° C. in gasoline/methanol/corrosive wafer solution) |
|---|---|
| VACOFLUX 17 | Corrosion pitting |
| VACOFLUX 50 | Corrosion pitting, structure visible |
| 93/7215 (0 wt % Co) | No change observed |
| 93/7216 (3 wt % Co) | No change observed |
| 93/7217 (6 wt % Co) | Small corrosion spots on one side |
| 93/7218 (9 wt % Co) | No change observed |
| 93/7342 (20 wt % Co) | Isolated small corrosion spots |

In a third corrosion test, samples were immersed in a sulphate, nitrate and chloride containing-solution. The solution comprises 1000 ppm sulphates, 500 ppm nitrates, 100 ppm chlorides and has a pH of 1.6. The samples were immersed in the solution for 11 days at 60° C. The results of this test are shown in Table 7.

TABLE 7

| Alloy | Optical evaluation after 92 hours | Degradation (after removal of the corrosion product) | Optical evaluation after 258 hours | Optical evaluation after removal of the corrosion product | Degradation (after removal of the corrosion product) |
|---|---|---|---|---|---|
| VACOFLUX 17 | Completely covered with a red oxide layer | 36.5 mg 32.6 g/m$^2$ d | Completely covered with a red oxide layer | Microstructure visible; matt dark grey discolouration | 57.6 mg 18.4 g/m$^2$ d |
| VACOFLUX 50 | Grey discolouration, microstructure visible | 39.1 mg 33.0 g/m$^2$ d | Blue discolouration; microstructure visible | Microstructure visible; matt light grey discolouration | 52.0 mg 15.6 g/m$^2$ d |
| 93/7215 (0 wt % Co) | Yellow discolouration, microstructure partly visible | 18.2 mg 15.4 g/m$^2$ d | Brown discolouration; Microstructure visible | Microstructure visible | 37.3 mg 11.2 g/m$^2$ d |
| 93/7216 (3 wt % Co) | Blank, microstructure partly visible | 25.5 mg 21.6 g/m$^2$ d | Grey discolouration with light regions | Microstructure visible in some regions | 30.8 mg 9.29 g/m$^2$ d |

TABLE 7-continued

| | | | | | |
|---|---|---|---|---|---|
| 93/7217 (6 wt % Co) | Yellow discolouration | 15.5 mg 13.1 g/m$^2$ d | Matt grey discolouration | Partly matt and partly shiny grey | 15.6 mg 4.69 g/m$^2$ d |
| 93/7218 (9 wt % Co) | Yellow discolouration | 16.7 mg 13.9 g/m$^2$ d | Green matt discolouration | Partly matt and partly shiny grey | 16.8 mg 5.00 g/m$^2$ d |
| 93/7342 (20 wt % Co) | Completely covered with a dark oxide layer | 38.5 mg 31.8 g/m$^2$ d | Completely covered with dark oxide layer | Oxide layer could not be completely removed. Light shiny under the layer | 54.1 mg 16.0 g/m$^2$ d |

| | | | | |
|---|---|---|---|---|
| Group 1 | Practically resistant | Weight loss of less than | 2.4 | g/m$^2$ day |
| Group 2 | Sufficiently resistant | Weight loss of | 2.4-24 | g/m$^2$ day |
| Group 3a | Reasonably resistant | Weight loss of | 24-72 | g/m$^2$ day |
| Group 3b | Little resistance | Weight loss of | 72-240 | g/m$^2$ day |
| Group 4 | Not resistant | Weight loss of more than | 240 | g/m$^2$ day |

As can be seen from Table 7, samples with 6 wt % cobalt and 9 wt % cobalt fulfilled the criterion of group 2 and are denoted as sufficiently corrosive resistant.

As illustrated in FIG. 2 and Table 2, the coercive field strength, $H_c$, was observed to increase for annealing temperatures above 700° C. with increasing cobalt content.

For crystalline alloys such as in the present application, good magnetic properties are related to a coarse microstructure. In principle, a coarse microstructure can be achieved by annealing the alloy at a temperature which is as high as possible in order to accelerate the diffusion process and the formation of a coarse microstructure.

However, for ferritic alloys, such as in case of the present application, the maximum annealing temperature is limited since the annealing should be carried out when the alloy is in the ferritic α-phase. If the annealing is carried out at a temperature above the phase transition temperature, the alloy is in a mixed phase or a non-ferritic phase and the magnetic properties are reduced.

This is illustrated in FIG. 2 and Table 2 by the increasing value of the coercive field strength observed for annealing temperatures above 700° C. The maximum annealing temperature is, therefore, around 700° C. For the alloys of FIG. 2, the phase transition temperature can, therefore, be assumed to lie at around 700° C.

In a further embodiment, the composition of the alloy was selected in order to increase the phase transition temperature and, therefore, the temperature at which the alloy may be annealed.

The result of these experiments are illustrated in FIGS. 14 15 and 16 and the compositions summarised in Tables 8, 9 and 10, respectively.

TABLE 8

| Batch | Cr (wt %) | Mn (wt %) | Si (wt %) | Mo (wt %) | Co (wt %) | Al (wt %) | S (wt %) | Ce (wt %) | Fe (wt %) |
|---|---|---|---|---|---|---|---|---|---|
| 93/7743 | 13.20 | | | | 9.25 | | | | Bal. |
| 93/7744 | 13.20 | | | | 11.40 | | | | Bal. |
| 93/7745 | 13.20 | | | | 13.50 | | | | Bal. |
| 93/7746 | 13.25 | | | | 15.60 | | | | Bal. |
| 93/7747 | 13.20 | | | | 17.70 | | | | Bal. |
| 93/7748 | 13.30 | | 0.30 | | 9.20 | | | | Bal. |
| 93/7749 | 13.10 | | | | 9.20 | 0.26 | | | Bal. |
| 93/7750 | 13.20 | 0.08 | | | 9.25 | 0.27 | 0.043 | 0.01 | Bal. |
| 93/7751 | 11.50 | | | 0.52 | 9.25 | | | | Bal. |
| 93/7752 | 10.10 | | | 0.52 | 9.20 | | | | Bal. |

TABLE 9

| Nr. | Cr (wt %) | Co (wt %) | Al (wt %) | Ti (wt %) | Fe (wt %) |
|---|---|---|---|---|---|
| 1 | 13.1 | 9.3 | 1.2 | 0 | Bal. |
| 2 | 13.1 | 9.3 | 1.2 | 1 | Bal. |
| 3 | 13.1 | 15.6 | 1.2 | 0 | Bal. |

As is illustrated in FIGS. 14 and 15, additions of Al, V and/or Ti result in an increase in the phase transition temperature. In FIG. 14, the alloys represented by the batch number 93/7749 and 93/7750 comprising an aluminium content of 0.26 wt % percent and 0.27 wt %, respectively, see Table 8, have only a small increase in coercive field strength when annealed at a temperature above 700° C. and below approximately 950° C. This is in contrast to the alloys without aluminium additions which show a rapid increase in coercive field strength for annealing temperatures above 700° C., see for example batch number 93/7743.

A plateau is observed in the curve of $H_c$ against annealing temperature for the two alloys with aluminium additions with the batch numbers 93/7749 and 93/7750 in the temperature range 700 to 950° C. This has the further advantage that the manufacture of the alloy is simplified since variations in the annealing temperature have relatively little influence on the magnetic properties. This is in contrast to the alloys without aluminium additions which show a rapid increase in $H_c$ with increasing temperature for temperatures greater around 700° C. so that for these alloys the annealing temperature has to be more closely controlled.

FIG. 15 illustrates the coercive field strength measured for three further alloys having an aluminium additions of 1.2 wt %, as summarized in Table 9. One of the alloys also comprises an addition of 1 wt % Ti in addition to 1.2 wt % Al. In all three cases, a value of $H_c$ of less than 6 A/cm is measured for annealing temperatures of 900° C. to 1150° C. For the third alloy with a larger cobalt content of 15.6 wt %, a decrease in coercive field strength $H_c$ was observed for increasing annealing temperature.

Therefore, the increase in $H_c$ which is observed for increasing cobalt content, as illustrated in FIG. 2, for example, can be compensated by the addition of elements Al, V and/or Ti which more strongly reduce the phase transition temperature than the cobalt content increases it. Therefore, the cobalt content can be increased in alloys comprising aluminium additions to improve the magnetic properties without this positive effect being outweighed by the reduction in a phase transition temperature.

FIG. 16 illustrates the effect of aluminium and the vanadium additions on the value of $H_c$ measured for different annealing temperatures. The compositions of these alloys are summarised in table 10.

TABLE 10

| Nr. | Cr (wt %) | Mn (wt %) | Si (wt %) | Mo (wt %) | Co (wt %) | Al (wt %) | V (wt %) | Fe (wt %) |
|---|---|---|---|---|---|---|---|---|
| 93/7964 | 13.25 | 0.02 | 0.02 | 0 | 10.25 | 0.34 | 0 | Bal. |
| 93/7965 | 13.30 | 0.01 | 0.01 | 0 | 10.25 | 0.84 | 0 | Bal. |
| 93/7966 | 13.30 | 0.02 | 0.02 | 0 | 10.25 | 1.40 | 0 | Bal. |
| 93/7967 | 13.00 | 0.01 | 0.04 | 0 | 10.30 | 1.39 | 1 | Bal. |
| 93/7968 | 13.20 | 0.01 | 0.07 | 0 | 13.4 | 1.36 | 0.99 | Bal. |
| 93/7969 | 13.25 | 0.01 | 0.03 | 0 | 16.5 | 1.32 | 0.99 | Bal. |
| 93/7970 | 13.15 | 0.01 | 0.02 | 0 | 20.7 | 1.27 | 0.99 | Bal. |
| 93/7971 | 9.96 | 0.01 | 0 | 1.7 | 9.2 | 1.2 | 0 | Bal. |
| 93/7972 | 8.9 | 0.01 | 0 | 21.94 | 13.45 | 1.15 | 0 | Bal. |

The alloys with batch number 93/7964, 93/7965 and 93/7966 illustrate the effect of increasing aluminium content. These the alloys do not include a vanadium addition. As can be seen in FIG. 16, the value of $H_c$ measured for an annealing temperature above 700° C. is increasingly reduced as the aluminium content is increased up to an annealing temperature of around 1000° C. For an annealing temperature of about 1180° C., the alloy with batch number 93/7964 and an aluminium content 0.34 wt % shows an increase in $H_c$ whereas the alloys with a higher aluminium content each have value of $H_c$ which is still below 5 A/cm.

Batch number 93/7967 further includes a vanadium addition of 1 wt % as well as an aluminium addition of 1.39 wt %. As illustrated in FIG. 16, the value of $H_c$ measured for an annealing temperatures of up to 1180° C. is smaller than that achieved by the use of aluminium additions alone.

The effect of increasing cobalt content in alloys comprising aluminium and vanadium additions was also investigated. The composition of these alloys is summarised in table 10 by the batch numbers 93/7967 to 93/7970.

As can be seen from the results given in FIG. 16, the value of $H_c$ measured for alloys annealed at temperatures above around 800° C. increases with increasing cobalt content. The alloy with a cobalt content of 13.4 wt % has the value of $H_c$ of less than 5 A/cm and the alloy with a cobalt content of 16.5 wt % as value of $H_c$ of around 7 A/cm which is significantly lower than alloys having a cobalt content in this range without aluminium and vanadium additions, as is illustrated by a comparison of the values of $H_c$ illustrated in FIG. 2.

In a further embodiment, alloys with aluminium and molybdenum additions were investigated. These alloys have the batch numbers 93/7971 and 93,7972 and the compositions are summarised in Table 10.

The results of the value of $H_c$ measured for these alloys annealed at different temperatures are also summarised in FIG. 16. These results show that a value of $H_c$ of less than 5 A/cm can be obtained for an annealing temperatures in the range 800° C. to 1180° C. for alloys with aluminium and molybdenum additions.

The batch numbers 93/7971, 93/7972, 93/7965, and 90/7968 and 93/7967 have a plateau in the value of $H_c$ for annealing temperatures in the range 800° C. to 1180° C. This has the advantage that variations in annealing temperature have relatively little influence on the magnetic properties of the alloys. The optimum manufacturing window is, therefore, relatively wide which simplifies the manufacturing process.

The results obtained for the alloys illustrated in FIGS. 14 to 16 indicate that the transition temperature at which the alloy leaves the ferritic α phase and goes into the mixed or non.ferritic phase has increased and moved to higher temperatures since the value of the coercive field strength, $H_c$, remains at a low value, for example below 5 A/cm for annealing temperatures above 700° C. This is in contrast to the alloys without aluminium, vanadium and/or titanium additions, as illustrated in FIG. 2 and table 2, in which the annealing temperature is limited to a value of around about 700° C. as the value of the coercive field strength, $H_c$, increases for annealing temperatures above about 700° C.

What is claimed is:

1. A magnetic component for a magnetically actuated fuel injection device, the magnetic component being formed of a corrosion resistant soft magnetic alloy consisting of, in weight percent, 9%<Co<20%, 11%≦Cr≦19%, 0%≦S≦0.5%, 0%≦Mn≦4.5%, 0.2%≦Al≦2.0%, 0%≦Si≦3.5%, 0%≦C<0.05%, 0%≦P<0.1%, 0%≦N<0.5%, 0%≦O<0.05%, 0%≦B<0.01%, V=0%, Ti=0%, Mo=0%, and the balance being iron and the usual impurities.

2. The magnetic component according to claim 1, wherein the magnetic component is prepared by a process comprising the step of annealing at a temperature between 650° C. and 800° C.

3. The magnetic component according to claim 2, wherein the magnetic component is prepared by a process comprising the step of annealing at a temperature of around 700° C. for five hours.

4. The magnetic component according to claim 1, wherein 10.5%<Co<18.5%.

5. The magnetic component according to claim 1, wherein 0.01%≦Mn≦1% and 0.005%≦S≦0.5%.

6. The magnetic component according to claim 1, wherein 0.01%≦Mn≦0.1% and 0.005%≦S≦0.05%.

7. The magnetic component according to claim 1, wherein the ratio Mn/S≧1.7.

8. The magnetic component according to claim 1, wherein the fuel injection device is a direct fuel injection valve.

9. A magnetic component for a magnetically actuated fuel injection device, the magnetic component being formed of a corrosion resistant soft magnetic alloy consisting of, in weight percent, 0%<Co<20%, Cr=13%, V=0% and the balance being iron and the usual impurities and wherein the magnetic component is prepared by a process comprising the step of annealing at a temperature between 650° C. and 800° C.

10. The magnetic component according to claim 9, wherein 6%<Co<16%.

11. The magnetic component according to claim 9, wherein 10.5%<Co<18.5%.

* * * * *